United States Patent [19]

Christmann

[11] Patent Number: 4,774,895

[45] Date of Patent: Oct. 4, 1988

[54] WASTE PYROLYSIS METHOD AND APPARATUS

[75] Inventor: Arvid Christmann, Pulheim, Fed. Rep. of Germany

[73] Assignee: Deutsche Babcock Anlagen Aktiengesellschaft, Oberhausen, Fed. Rep. of Germany

[21] Appl. No.: 62,878

[22] Filed: Jun. 15, 1987

[30] Foreign Application Priority Data

Aug. 1, 1986 [DE] Fed. Rep. of Germany ..... 3626106

[51] Int. Cl.[4] ..... F23B 7/00

[52] U.S. Cl. ..... 110/234; 48/76; 48/203; 110/226; 110/229; 110/346

[58] Field of Search ..... 110/229, 346, 226, 341, 110/234; 48/76, 203

[56] References Cited

U.S. PATENT DOCUMENTS

| | | | |
|---|---|---|---|
| 3,818,869 | 6/1974 | Blaskowski | 110/229 X |
| 3,859,933 | 1/1975 | Von Klenck | 110/226 |
| 4,206,186 | 6/1980 | Hölter et al. . | |
| 4,432,290 | 2/1984 | Ishii et al. | 110/229 X |
| 4,485,745 | 12/1984 | Bracker et al. | 110/229 |

FOREIGN PATENT DOCUMENTS

| | | |
|---|---|---|
| 346997 | 12/1978 | Austria . |
| 0111081 | 6/1980 | European Pat. Off. . |
| 2331752 | 11/1975 | France . |
| 2432504 | 1/1976 | Fed. Rep. of Germany . |
| 2732418 | 1/1979 | Fed. Rep. of Germany . |
| 3400976 | 1/1984 | Fed. Rep. of Germany . |
| 3447079 | 12/1984 | Fed. Rep. of Germany . |

OTHER PUBLICATIONS

"Müll and Abfall" 4/85, pp. 122–126, 4–85.

O. Tabsaran–"Abfallbeseitigung und Abfallwirtschaft-"-pp. 198, 199, 9–83.

PCB–Possibilities of Destruction by A. Peterson, National Swedish Environment Protection Board.

*Primary Examiner*—Edward G. Favors

*Attorney, Agent, or Firm*—Herbert Dubno

[57] ABSTRACT

A pyrolysis reactor is coupled with an incinerator plant in the pyrolysis apparatus of our invention. In one variant the pyrolysis gas arrives directly in the furnace of the incinerator plant. In another variant the pyrolysis gas is burned in an additional separate combustion chamber and the flue gas arising from its combustion is fed into the flue gas duct of the incinerator. Because of that the units required in an economically self sufficient pyrolysis plant for purifying and using the pyrolysis gas and for the exhaust gas cleaning are made more economical. A process for consuming waste according to our invention is also described.

11 Claims, 2 Drawing Sheets

WASTE PYROLYSIS METHOD AND APPARATUS

FIELD OF THE INVENTION

My present invention relates to a method of and to an apparatus for the pyrolysis of waste, especially organic and other industrial waste.

BACKGROUND OF THE INVENTION

A waste pyrolysis apparatus is known for the pyrolysis of waste, particularly of a scrap, residue-laden or industrial charge of pyrolyzable waste, with an indirectly heated pyrolysis reactor from which a pyrolysis gas pipe is fed to a combustion chamber. A process for disposing of waste is known which comprises pyrolyzing the waste and subsequently burning the pyrolysis gas produced.

It is possible to do away with certain problem waste materials in an environmentally friendly way with the help of pyrolysis.

By pyrolysis, I mean heating to effect chemical changes including gas production by the heating process alone.

By "waste or waste materials", I means particularly the so-called aged or ripened loads of waste such as earth contaminated with oil or solvents, animal residues, acid sludge and the like. Also, I include special waste such as old tires or residue from plastic insulated electrical cables. A solid material occurs as a product of this process which contains recoverable and/or landfill depositable substances. Furthermore a combustible pyrolysis gas is produced.

This pyrolysis apparatus is described in Austrian Patent No. 346 997. That the use of the pyrolysis product gas in the typical gas burner or in an internal combustion engine is associated with practical problems because of the composition of the pyrolysis gas and the different additives contained in it, is not disclosed by this reference.

Considerable expense is required to treat this pyrolysis gas in a peripheral unit as can be learned from German Patent documents Nos. 27 32 418, 24 32 504 and from U.S. Pat. No. 4,206,186.

Of course the formation of certain gaseous impurities such as halogen containing acids or sulfur dioxide can be avoided by introducing a fine grained basic material before or during the sulfurization process as has been disclosed is European Patent Application No. 0 111 081 and the above mentioned Austrian Patent No. 346 997. Then the expense for subsequent removal of these gas components is saved. On the other hand, a greatly increased dust content of the pyrolyzed gases causes an increased expense for dust removal.

One problem is that suitable customers for the pryolysis gas produced in reduced quantities and with poor quality are not always present. Use of the pyrolysis plant itself presupposes a suitable gas-purification apparatus.

An economically self sufficient pyrolysis process, i.e. a process which permits purification and use of the pyrolysis gas, requires a large investment. Such an expenditure can not always be economically justified. This is especially true when the amount of the materials to be removed—e.g. more so with industrial and scrap charges—is limited so that the plant is only useful for a limited time.

OBJECTS OF THE INVENTION

It is an object of my invention to provide an improved pyrolysis process and apparatus for pyrolyzing waste which will obviate prior-art drawbacks.

It is also an object of my invention to provide an improved pyrolysis process and apparatus for pyrolyzing waste which has a reduced investment cost.

It is another object of my invention to provide an improved pyrolysis process and apparatus for pyrolyzing waste in which some expenses for purification of the pyrolysis gas are saved.

SUMMARY OF THE INVENTION

These objects and others which will become more readily apparent hereinafter are attained in accordance with my invention in a waste pyrolysis apparatus for pyrolysis of waste, particularly of industrial and scrap charges of waste, comprising an indirectly heated pyrolysis reactor from which a pyrolysis gas pipe feeds to a combustion chamber. They are also attained in a pyrolysis process for waste comprising pyrolyzing the waste and subsequently burning the product pyrolysis gas.

According to my invention, the combustion chamber is the furnace of a garbage incinerator plant. This is a particularly simple and economical solution to the problem my invention is designed to solve.

Alternatively, according to my invention, a flue gas pipe extending from another separate combustion chamber for the pyrolysis gas opens into a flue gas duct of the furnace of an incinerator plant. This second alternative is provided for the special case in which the pyrolysis gas contains thermally stable substances, such as dioxin and especially for pyrolysis of PCB-containing residues from transformer oil.

Both solutions are based on the common concepts of burning the impure pyrolysis gas and using the units present in an incinerator for purifying the flue gas. This is possible in most practical cases without problems since the amount of organic components of the special waste to be removed by pyrolysis is comparatively small in comparison to the amount of typical community and commercial garbage or refuse which is put through the incinerator.

Advantageously the residual heat in the partially burned gases used to heat the pyrolysis reactor can be utilized in one example of my invention in which an exhaust gas pipe extending from the heater compartment of the pyrolysis reactor opens into the flue gas duct at a section of said duct inside of a steam boiler downstream from the furnace.

A particularly advantageous economical portable treatment only to a limited extent, is attained when the pyrolysis reactor is portable.

A branch pipe branching from the flue gas duct can be fed to the pyrolysis reactor to permit additional fuel savings for the pyrolysis. This is especially significant when the pyrolyzed material to be treated only has a reduced energy content.

A process according to my invention for consuming waste, particularly for consuming an aged load of said waste, comprises pyrolyzing the waste to form a pyrolysis gas, feeding the pyrolysis gas to a furnace of an incinerator for combustion, feeding the exhaust gas required to provide heat for the pyrolysis to a steam boiler downstream from the furnace and feeding back a portion of the flue gas from the furnace to fuel the combustion required to provide heat for the pyrolysis.

Alternatively another process for consuming waste, particularly an aged load of said waste, according to my invention comprises pyrolyzing the waste to form a pyrolysis gas, feeding the pyrolysis gas to a combustion chamber attaining temperatures of at least 1200° C., feeding the exhaust gas from the combustion chamber to the flue gas from a furnace of an incinerator, feeding the combustion product gas required to provide heat for the pyrolysis to a steam boiler downstream of the furnace and feeding a portion of the flue gas from the furnace back to the pyrolysis to provide at least a portion of the heat for the pyrolysis.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
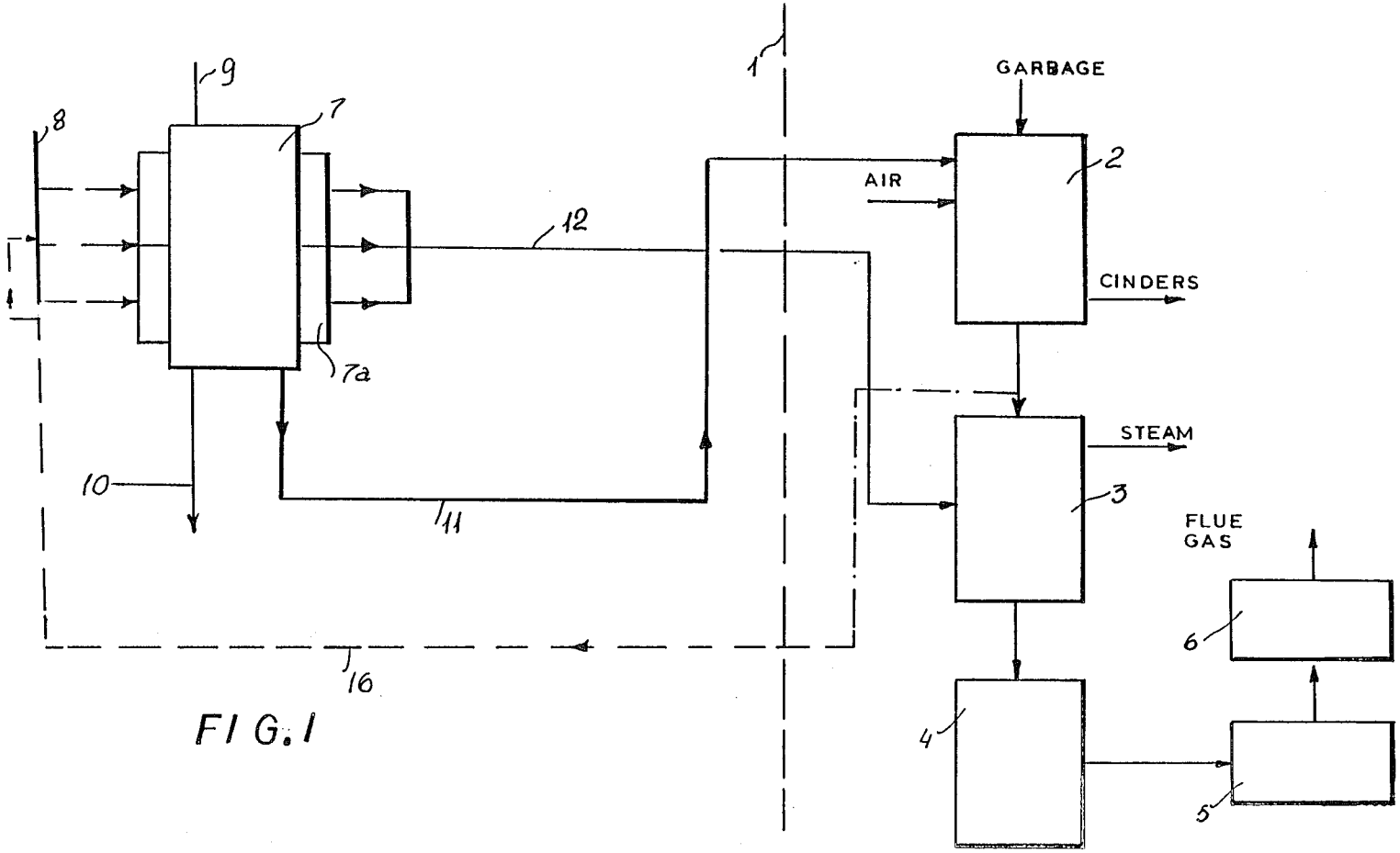
FIGS. 1 and 2 are schematic diagrams showing two pyrolysis plants according to my invention.

A conventional refuse or garbage incinerator indicated in FIG. 1 by the dashed boundary line 1 comprises a furnace 2, a steam boiler 3, a gas scrubber 4, a flue 5 and a chimney 6. The arrows drawn between the individual units illustrate symbolically the gas flow.

In regard to the combustion my invention does not require a particular system or unit. It can be a roller grate or sliding grate combustor for burning common house garbage and business waste or a rotating cylindrical furnace with or without after burner for burning industrial or special waste.

A pyrolysis reactor 7, advantageously an indirectly heated rotating cylindrical oven, is located in the immediate vicinity of the refuse incinerator 1. This pyrolysis reactor 7 has feed pipes 8 for fuel and combustion air. The rotating cylindrical oven 7 is supplied with waste or refuse by a delivery device 9, e.g. with oil impregnated earth. Solid tailings are discharged using a discharge device 10. The pyrolysis gas is conducted by a pipe 11, which is insulated thermally to avoid condensation and is as short as possible, into the furnace 2 and there it is burned with an unshown burner which acts as a burner nozzle for the waste combustion. The flue gas from the burner mixes with the flue gas from the waste burning and contributes to the heating of the steam boiler 3. The exhaust gas from the heater portion *7a* of the pyrolysis reactor 7 is conducted by an exhaust gas pipe 12 into the appropriate thermal zone in the steam boiler 3 where it delivers its heat and mixes with the standard flue gas flow. The flue gas is freed or separated from the solid and gas mixture in the flue gas purification unit or scrubber 4 and reaches the atmosphere through the chimney 6 connected to the flue 5.

Figure 2:
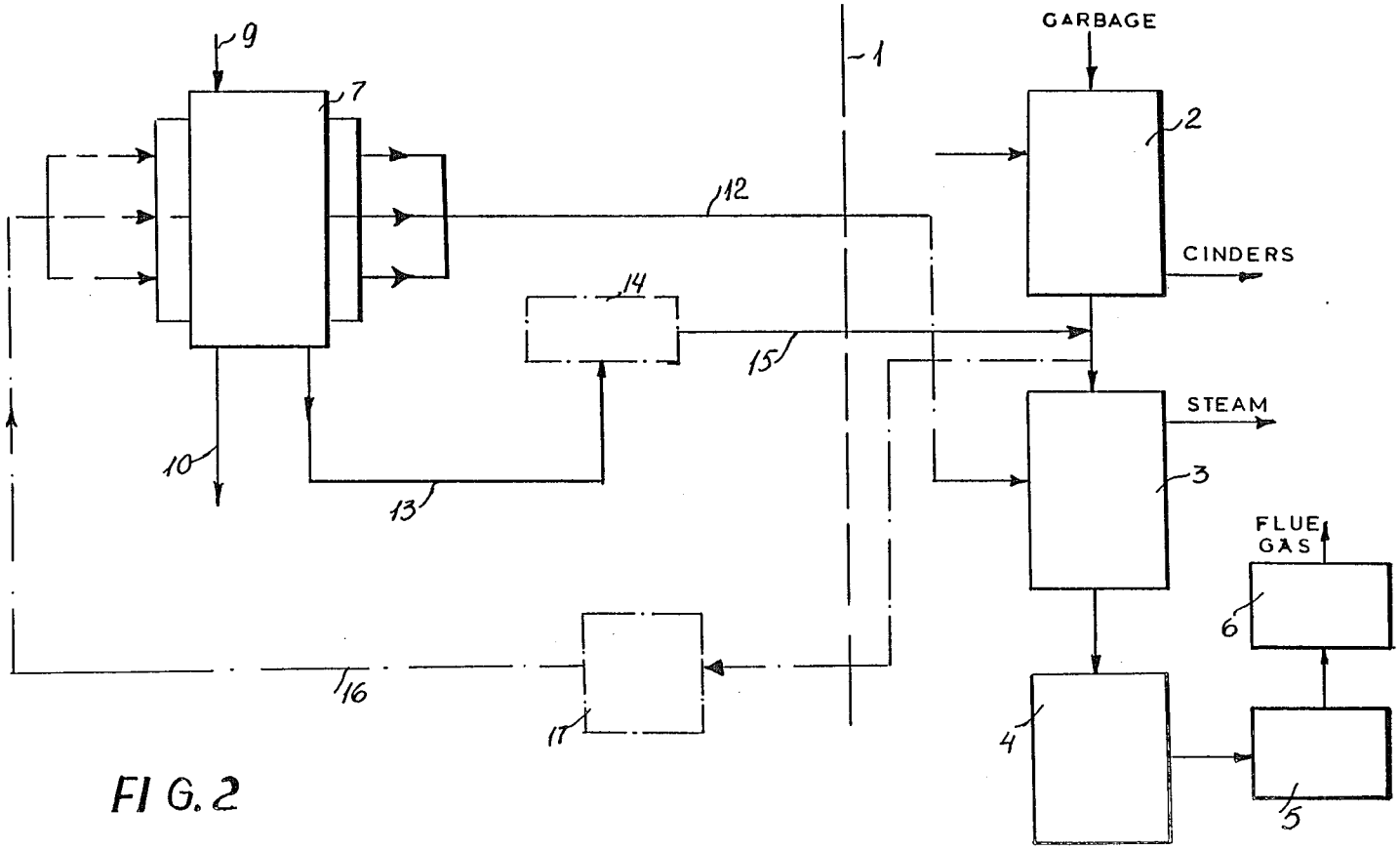

The embodiment of the plant shown in FIG. 2 is provided especially for the removal of waste which can contain deleterious thermally stable materials such as chlorinated biphenyls (PCBs). It differs from the plant according to FIG. 1 in that an additional separate combustion chamber 14 is fed the pyrolysis gas by a pipe 13 and is burned separately there at a temperature over 1200° C. A very reliable decomposition of the deleterious material is attained by the increased combustion temperature. A flue gas temperature level from 800° to 900° C. in standard incineration can be maintained in the furnace 2. The flue gas arising in the combustion chamber 14 is conducted by a flue gas pipe 15 into the flue gas duct of the furnace 2 upstream of the entrance to the steam boiler 3.

The heating of the pyrolysis reactor 7 occurs in the plant according to FIG. 2 by a partial flow of heated flue gas which is fed from a point upstream of the steam boiler 3 by a branch pipe 16 branching from the flue gas duct through a gas filter 17 to the pyrolysis reactor 7. This can also be done in the above mentioned previous embodiment as is shown in FIG. 1.

Otherwise the plant illustrated in FIG. 2 coincides with that of FIG. 1 which has been described above. The heating of the pyrolysis reactor with hot flue gas from the incinerator is naturally possible when as in the Example shown in FIG. 1 the pyrolysis gas is burned in the incinerator.

Of course both FIGS. 1 and 2 are flow charts for a process for consuming waste according to my invention.

I claim:

1. In a waste pyrolysis apparatus for pyrolysis of waste into pyrolysis gas, particularly of a charge of industrial scrap and organic residue of said waste, with an indirectly heated pyrolysis reactor from which a pyrolysis gas pipe is fed to a combustion chamber, the improvement wherein said combustion chamber is the furnace of an incinerator plant and said pyrolysis gas from said reactor is fed through said pipe unpurified directly into said chamber, and an exhaust gas pipe extending from a heater compartment of said pyrolysis reactor opens into a flue gas duct at a section of said duct inside of a steam boiler downstream from said furnace.

2. The improvement defined in claim 1 wherein a branch pipe branching from said flue gas duct is fed to said pyrolysis reactor.

3. The improvement defined in claim 1 wherein said pyrolysis reactor is portable.

4. In a waste pyrolysis apparatus for pyrolysis of waste, particularly of a charge of industrial scrap and organic residue of said waste, with an indirectly heated pyrolysis reactor from which a pyrolysis gas is fed to one combustion chamber, the improvement wherein a flue gas pipe extending from another separate combustion chamber for said pyrolysis gas opens into a flue gas duct of the furnace of an incinerator plant.

5. The improvement defined in claim 4 wherein an exhaust gas pipe extending from the heater compartment of said pyrolysis reactor opens into said flue gas duct inside of a steam boiler downstream from said furnace.

6. The improvement defined in claim 4 wherein said pyrolysis reactor is portable.

7. The improvement defined in claim 4 wherein a branch pipe branching from said flue gas duct is fed to said pyrolysis reactor.

8. A waste pyrolysis apparatus for pyrolysis of waste, particularly of a charge of industrial scrap and organic residue of said waste, comprising:

an indirectly heated pyrolysis reactor having a heater compartment;

an incinerator plant having a steam boiler connected downstream of a furnace of said incinerator plant to which a pyrolysis gas pipe fed from said pyrolysis reactor is connected;

an exhaust gas pipe extending from said heater compartment of said pyrolysis reactor and opening into a flue gas duct at a section of said duct inside of said steam boiler; and a branch pipe branching from said flue gas duct fed to said pyrolysis reactor.

9. A waste pyrolysis apparatus for pyrolysis of waste, particularly of a charge of industrial scrap and organic residue of said waste, comprising:

an indirectly heated pyrolysis reactor having a heater compartment;

an incinerator plant having one combustion chamber which is a furnace;

another separate combustion chamber for said pyrolysis gas connected to said indirectly heated pyrolysis reactor from which a flue gas pipe opens into a flue gas duct of said furnace of said incinerator plant;

an exhaust gas pipe extending from said heater compartment of said pyrolysis reactor opening into said flue gas duct of said incinerator inside of a steam boiler downstream from said pyrolysis reactor; and a branch pipe branching from said flue gas duct feeding said pyrolysis reactor.

10. A process for consuming waste, particularly for consuming a charge of industrial scrap and organic residue of said waste, comprising:

(a) pyrolyzing said waste to form a pyrolysis gas;

(b) feeding said pyrolysis gas to a furnace of an incinerator;

(c) feeding the exhaust gas required to provide heat for said pyrolysis to a steam boiler of said incinerator downstream from said furnace; and (d) feeding back a portion of the flue gas from said furnace to provide heat for said pyrolysis.

11. A process for consuming waste, particularly a charge of industrial scrap and organic residue of said waste, comprising:

(a) pyrolyzing said waste to form a pyrolysis gas;

(b) feeding said pyrolysis gas to a combustion chamber attaining a temperature of at least 1200° C.;

(c) feeding the flue gas from said combustion chamber to the flue gas duct of a furnace of an incinerator;

(d) feeding the exhaust gas required to provide heat for said pyrolysis to a steam boiler downstream of said furnace; and (e) feeding a portion of said flue gas from said furnace back to said pyrolysis to provide at least a portion of said heat for said pyrolysis.

* * * * *